US007061830B2

(12) United States Patent
Mallison et al.

(10) Patent No.: US 7,061,830 B2
(45) Date of Patent: Jun. 13, 2006

(54) TRANSDUCERS COATED WITH ANECHOIC MATERIAL FOR USE IN DOWN HOLE COMMUNICATIONS

(75) Inventors: Edgar R. Mallison, Wayzata, MN (US); Thomas G. Stratton, Roseville, MN (US)

(73) Assignee: Honeywell International Inc., Morristown, NJ (US)

( * ) Notice: Subject to any disclaimer, the term of this patent is extended or adjusted under 35 U.S.C. 154(b) by 201 days.

(21) Appl. No.: 10/299,509

(22) Filed: Nov. 19, 2002

(65) Prior Publication Data

US 2004/0095848 A1 May 20, 2004

(51) Int. Cl.
*G01V 1/40* (2006.01)

(52) U.S. Cl. ..... 367/25; 367/81; 367/83

(58) Field of Classification Search ..... 166/250.15, 166/50, 53, 65.1; 367/82, 83, 25, 81; 175/40–80; 181/207, 208

See application file for complete search history.

(56) References Cited

U.S. PATENT DOCUMENTS 4,860,851 A * 8/1989 Krevor et al. ..... 181/207
4,883,143 A * 11/1989 Lagier ..... 181/286
5,485,053 A * 1/1996 Baz ..... 310/326
6,176,312 B1 1/2001 Tubel et al.

FOREIGN PATENT DOCUMENTS

WO WO 91/03808 * 3/1991
WO WO 91/03808 A1 * 3/1991

OTHER PUBLICATIONS

The American Heritage Dictionary of the English Language, 2000, Fourth Edition.*
WordNet 1.6, 1997 Princeton University.*

* cited by examiner

*Primary Examiner*—Ian J. Lobo
(74) *Attorney, Agent, or Firm*—Schiff Hardin LLP

(57) ABSTRACT

A communication device is located within a well and includes a transducer that converts a first electrical signal into a first acoustic signal for transmission through the well and that converts second acoustic signal received from the well to a second electrical signal. The transducer is at least partially coated with an anechoic material in order to reduce the effects of acoustic signal impairments, such as echoes, flow and machine noise, and reverberations. The anechoic material has a thickness that is a fraction of a wavelength of the acoustic signals.

37 Claims, 3 Drawing Sheets

TRANSDUCERS COATED WITH ANECHOIC MATERIAL FOR USE IN DOWN HOLE COMMUNICATIONS

TECHNICAL FIELD OF THE INVENTION

The present invention relates to transducers that are used to communicate messages through wells.

BACKGROUND OF THE INVENTION

The control of oil and/or gas production wells has become increasingly complex. Wells under the control of a single company are being drilled throughout the world. Therefore, the need for central control of wells that are widely dispersed geographically presents challenges to the communication of sensor and logging information from the wells to the central controller and to the communication of control information from the central controller to the wells.

Moreover, the wells themselves have become increasingly more complex. For example, well holes are being drilled with multiple branches and are being divided into multiple production zones that discretely produce fluid in either common or discrete production tubing. As a result, the importance of communications between zones of a well, between the well and the surface, and between wells has increased.

As a consequence, it is known to position sophisticated computer and telecommunication equipment at the surface of wells and within the wells for supporting the communication of sensor, logging, and control information. The equipment within the well hole has usually been hardwired together and to the equipment at the surface. However, signals have also been acoustically communicated between this equipment. In this latter case, the information and control signals may be acoustically communicated at variable frequencies, at specific fixed frequencies, and/or using codes. Also, such acoustic signals may be transmitted through casing streams, electrical lines, slick lines, subterranean soil, tubing fluid, and/or annulus fluid.

Transmitters that convert electrical signals to acoustic signals are used to transmit the acoustic signals, and receivers that convert the acoustic signals back to electrical signals are used to receive the acoustic signals. These transmitters and receivers typically include transducers, such as piezoelectric transducers, to perform the required conversions. Piezoelectric transducers generate a mechanical force when alternating current voltage is applied thereto. The signal generated by the stressing of the piezoelectric transducers travels along the borehole between transmitters and receivers that are situated at the various sensing and control locations along the well and at the surface.

When acoustic signals are used to communicate sensor, logging, and control information through a well, various acoustic signal impairments, such as echoes, flow and machine noise, and reverberations, can interfere with the accurate recovery of the sensor, logging, control information from the acoustic signals. The present invention addresses this problem by coating the transducers of a down hole communication system with an anechoic material.

SUMMARY OF THE INVENTION

In accordance with one aspect of the present invention, a communication device is located within a well and comprises a controller, a transducer, and an anechoic coating. The controller processes an electrical signal. The transducer is coupled to the controller and performs a conversion between the electrical signal and an acoustic signal. The anechoic coating is provided over at least a portion of the transducer and reduces the effects of acoustic signal impairments.

In accordance with another aspect of the present invention, a communication device located within a well comprises a transducer and an anechoic coating. The transducer is arranged to perform a conversion between an electrical signal and an acoustic signal, the acoustic signal conveys information through the well, and the acoustic signal has a wavelength λ. The anechoic coating is provided over at least a portion of the transducer. The anechoic coating has a thickness that is related to the wavelength of the acoustic signal by $$\frac{x\lambda}{y}$$

so as to reduce effects of acoustic signal impairments, wherein x and y are integers, wherein x may be less than y, wherein x may be equal to y, and wherein x may be greater than y provided that x/y is an integer In accordance with still another aspect of the present invention, a communication system for communicating information to and from a well comprises a surface monitoring and control system and a down hole monitoring and control system. The surface monitoring and control system is located at a surface and supports communication through the well via an acoustic signal. The surface monitoring and control system includes a first transducer that performs a conversion between a first electrical signal and the acoustic signal, and the first transducer is at least partially coated with a first anechoic material that reduces the effects of acoustic signal impairments. The down hole monitoring and control system is located within the well and supports communication through the well via the acoustic signal. The down hole monitoring and control system includes a second transducer that performs a conversion between a second electrical signal and the acoustic signal, and the second transducer is at least partially coated with a second anechoic material that reduces the effects of acoustic signal impairments.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
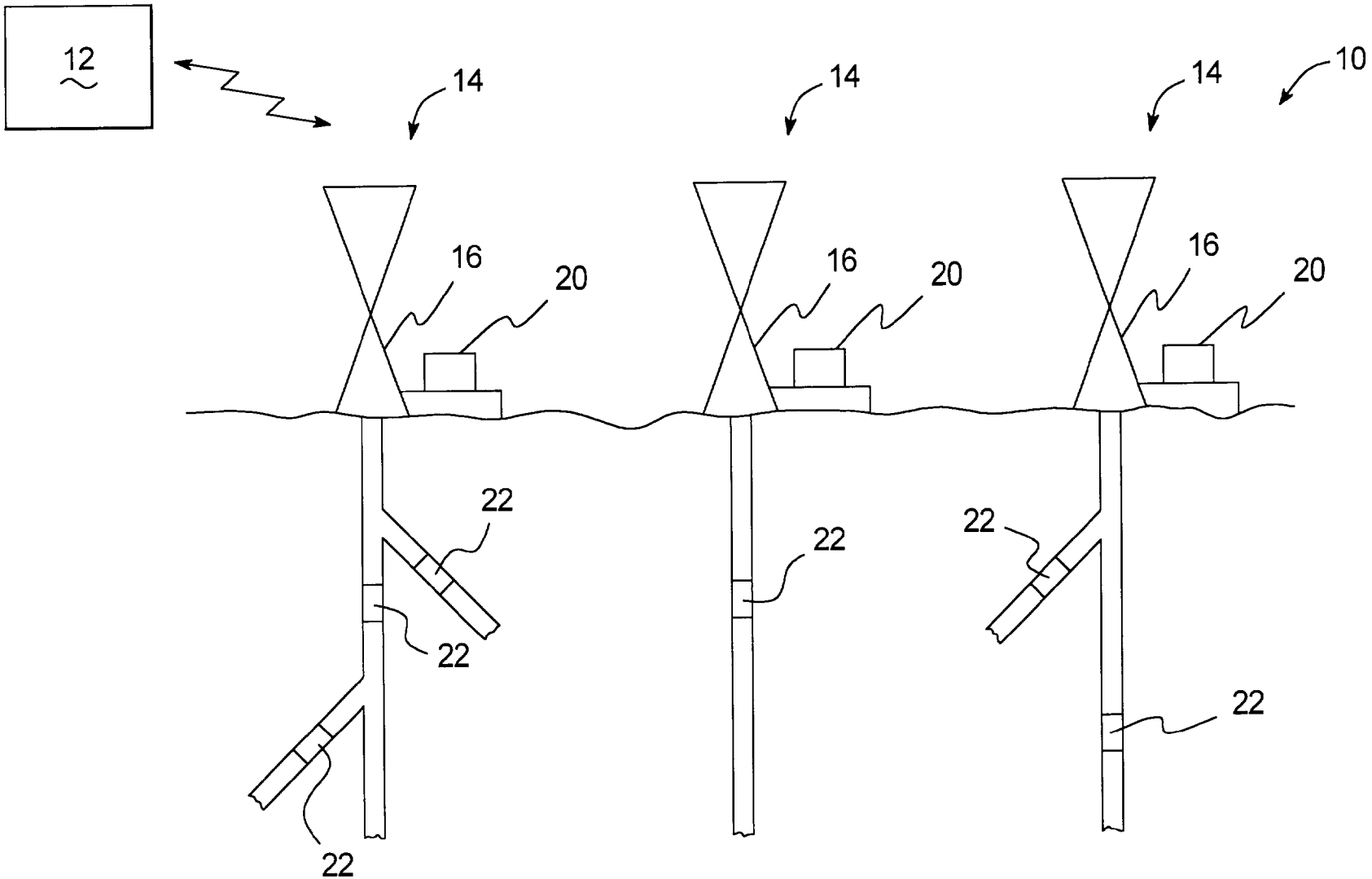
FIG. 1 illustrates a monitoring and control system in accordance with one embodiment of the present invention.

As shown in FIG. 1, a monitoring and control system 10 includes a remote central control center 12 that communicates with a plurality of wells 14. Although only three wells are shown in FIG. 1, it should be understood that the monitoring and control system 10 may include any number of wells. Because the wells 14 may be geographically dispersed, the remote central control center 12 may communicate with the wells 14 using cellular transmissions, satellite transmissions, telephone lines, and/or the like.

Each of the wells 14 is provided with a corresponding well platform 16 located at the surface of the corresponding one of the wells 14. As shown, the wells 14 extend from the well platforms 16 downwardly into the earth. However, it should be understood that, while the wells 14 are shown over land, one or more of the wells 14 may instead extend down from offshore platforms.

If desired, each of the wells 14 may be divided into a plurality of separate branches, although each of the wells 14 may instead comprise a single downwardly directed bore. In addition, it is possible to divide each of the wells 14 into multiple zones that require separate or group monitoring and/or control for efficient production and management of the well.

A surface monitoring and control system 20 is provided on each of the well platforms 16 and a down hole monitoring and control system 22 is provided within each of the wells 14 and, if desired, within each of the zones of each of the wells 14.

The surface monitoring and control system 20 is arranged to communicate with the down hole monitoring and control systems 22 within its corresponding well. In this case, the surface monitoring and control system 20 and the down hole monitoring and control systems 22 associated with one of the wells 14 are arranged to communicate with one another through the use of acoustic signals.

Moreover, the surface monitoring and control system 20 mounted on one of the well platforms 16 may be further arranged to communicate with the down hole monitoring and control systems 22 within one or more of the other wells 14 in order to provide redundant monitoring and control of each of the wells 14 from the surface. In this case also, the surface monitoring and control system 20 and the down hole monitoring and control systems 22 associated with different ones of the wells 14 may be arranged to communicate with one another through the use of acoustic signals.

Likewise, the down hole monitoring and control systems 22 within each of the wells 14 may be arranged to communicate with the down hole monitoring and control systems 22 in one or more of the other wells 14 in order to provide additional redundancy. In this case, the down hole monitoring and control systems 22 of different ones of the wells 14 may communicate with one another through the use of acoustic signals.

Furthermore, the surface monitoring and control systems 20 mounted on the well platforms 16 may be arranged to communicate with one another. In this case, the surface monitoring and control systems 20 may communicate with one another using cellular transmissions, satellite transmission, telephone lines, and/or the like.

Figure 2:
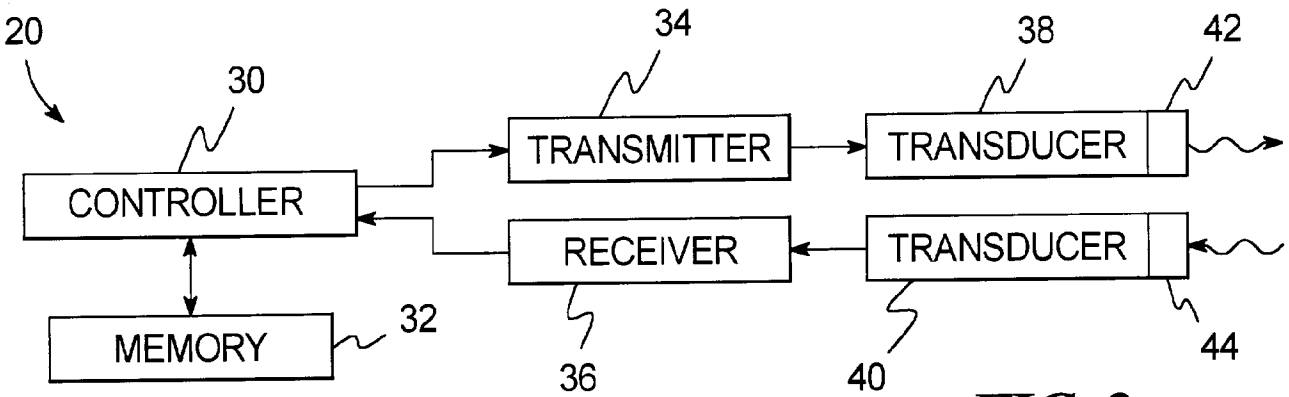
FIG. 2 illustrates a representative one of the surface monitoring and control systems shown in FIG. 1.

A representative one of the surface monitoring and control systems 20 is shown in FIG. 2. Accordingly, each of the surface monitoring and control systems 20 includes a controller 30, a memory 32, a transmitter 34, a receiver 36, a transducer 38, and a transducer 40. The controller 30, for example, may be a microprocessor programmed to acquire sensor and logging information from the down hole monitoring and control systems 22 within its corresponding well 14. As discussed above, the controller 30 may also be arranged to acquire sensor and logging information from the down hole monitoring and control systems 22 within others of the wells 14. The controller 30 may further be arranged to communicate control information to the down hole monitoring and control system 22 within its corresponding well 14 and to the down hole monitoring and control systems 22 within others of the wells 14. In addition, the controller 30 may be arranged to communicate control information to, and receive sensor and logging information from, the surface monitoring and control systems 20 on other well platforms 16 and the remote central control center 12.

The controller 30 controls the transmitter 34 to transmit information to the down hole monitoring and control systems 22 within the wells 14. The controller 30 may employ any addressing scheme to transmit this information to a specific one or group of the down hole monitoring and control systems 22. Additional transmitters may be provided to permit the controller 30 to transmit information to the surface monitoring and control systems 20 on other well platforms 16 and to the remote central control center 12.

The transducer 38 converts the electrical signals from the transmitter 34 to acoustic signals, and the acoustic signals are then directed through the well and/or earth. These acoustic signals convey information to the desired destination. The transducer 38, for example, may be a piezoelectric transducer and is provided with an anechoic coating 42. As is known, anechoic coatings are coatings that modify the interface between the transmission media and the transducer in order to reduce reflected signals and to enhance the desired acoustic signals. The thickness of the anechoic coating 42 is selected to be a suitable fraction or multiple of the wavelength that is selected for the acoustic signals transmitted through the well and/or earth between the surface monitoring and control systems 20 and the down hole monitoring and control systems 22. For example, the thickness of the anechoic coating 42 may be selected to be ½ of the wavelength of the acoustic signal. Alternatively, the thickness of the anechoic coating 42 may be selected to be a multiple of the wavelength of the acoustic signal. The specific wavelength will depend upon the exact nature of the substances through which the acoustic signal must travel. These substances generally are petrochemicals, water, and earth, but other substances such as various acids and contaminants may also be present.

In any event, the thickness should be chosen so as minimize the effect of acoustic signal impairments, such as echoes, flow and machine noise, and reverberations, on the transducers used to transmit and receive communication signals as described above. Also, it is preferable that the specific material of the anechoic coating provided for the transducers should be selected to withstand the oils, acids, other substances, and high temperatures in the particular well hole that is encountered. Accordingly, the anechoic material may change from hole to hole depending upon the particular mixture of substances found in the specific well hole. Generally, these anechoic materials are some form of rubber or rubber-like material selected for long wear, for adhesion to the transducer interface, and for substantial imperviousness to the substances that are likely to be encountered.

For example, the anechoic coating 42 may be an elastomeric or elastomeric polymer, such as silicone, polyurethane, and/or polybutadiene based polymers, bonded to the external surface of the transducers. Particles may be provided in these substances in order to enhance the acoustic signal, and an organic or inorganic cover may be provided. Acoustic energy that arises from acoustic signal impairments, such as echoes, flow and machine noise, and reverberations, and that is incident upon the anechoic coating 42 deform the material of the anechoic coating 42 in order to dissipate this acoustic energy.

The transducer 40 converts the acoustic signals transmitted by other devices to corresponding electrical signals for processing by the receiver 36 and the controller 30. The transducer 40, for example, may be a piezoelectric transducer and is provided with an anechoic coating 44. The anechoic coating 44 may be similar to the anechoic coating 42.

The memory 32 of the surface monitoring and control system 20 stores the sensor and logging information received from the down hole monitoring and control systems 22. The memory 32 also stores the communication programming necessary to communicate with the down hole monitoring and control systems 22, the surface monitoring and control systems 20 on other well platforms 16 and the remote central control center 12. The memory 32 further stores the control programming necessary to control the down hole monitoring and control systems 22.

Figure 3:
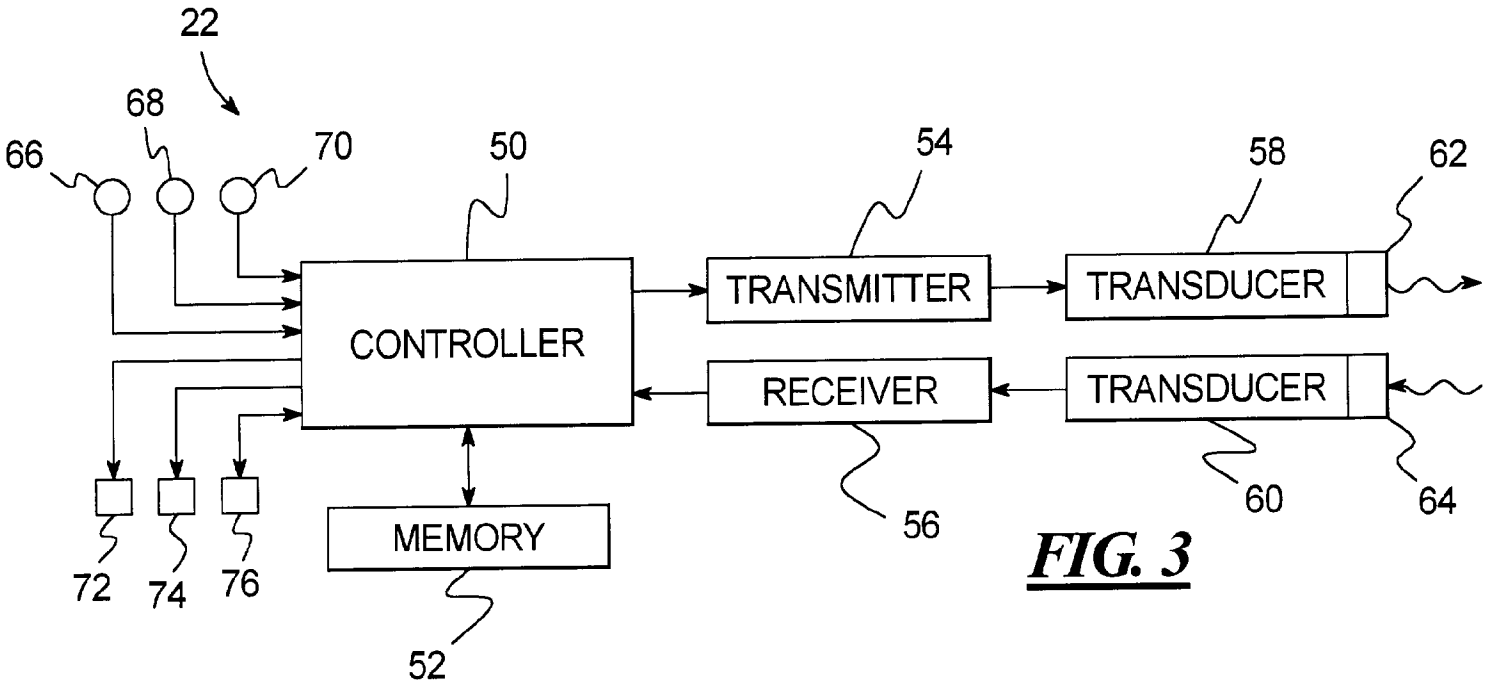
FIG. 3 illustrates a representative one of the down hole monitoring and control systems shown in FIG. 1.

A representative one of the down hole monitoring and control systems 22 is shown in FIG. 3. Thus, each of the down hole monitoring and control systems 22 includes a controller 50, a memory 52, a transmitter 54, a receiver 56, a transducer 58, and a transducer 60.

The controller 50 controls the transmitter 54 to transmit information to other down hole monitoring and control systems 22 and to the surface monitoring and control systems 20. The controller 50 may employ any addressing scheme, such as those described above, to transmit information to a specific one or group of destinations.

The transducer 58 converts the electrical signals from the transmitter 54 to acoustic signals and directs the acoustic signals through the well and/or earth. These acoustic signals convey information to the desired destination. The transducer 58, for example, may be a piezoelectric transducer and is provided with an anechoic coating 62 similar to the anechoic coatings 42 and 44.

The transducer 60 converts the acoustic signals transmitted by other devices to corresponding electrical signals for processing by the receiver 56 and the controller 50. The transducer 60, for example, may be a piezoelectric transducer and is provided with an anechoic coating 64. The anechoic coating 64 may be similar to the anechoic coatings 42, 44, and 62.

The controller 50, for example, may be a microprocessor programmed to acquire and log sensor information from sensors 66, 68, and 70 located in the down hole. The sensors 66, 68, and 70 may be selected to sense pertinent conditions with the well. For example, the sensor 66 may be a pressure sensor, the sensor 68 may be a temperature sensor, and the sensor 70 may be a flow sensor. Different, fewer, or additional sensors may be provided to sense the same or other conditions within the corresponding zone or well.

As discussed above, the controller 50 may also be arranged to perform control operations within a down hole. Therefore, the controller 50 may also be coupled to a valve 72, a pump 74, and/or another type of electromechanical device 76 as may be necessary to implement the desired control functions. Different, fewer, or additional actuators may be provided to control the same or other control functions within the corresponding zone or well.

The controller 50 may further be arranged to communicate control information to other down hole monitoring and control systems 22 within its corresponding well 14 and to the down hole monitoring and control systems 22 within others of the wells 14. In addition, the controller 50 may be arranged to communicate sensor and logging information to, and receive control information from, the surface monitoring and control systems 20 on its corresponding well platform 16 and on other well platforms 16.

The memory 52 of the down hole monitoring and control systems 22 stores the sensor and logging information. The memory 52 also stores the communication programming necessary to communicate with other down hole monitoring and control systems 22 and with the surface monitoring and control systems 20. The memory 52 further stores the control programming necessary to perform the required control functions.

Figure 4:
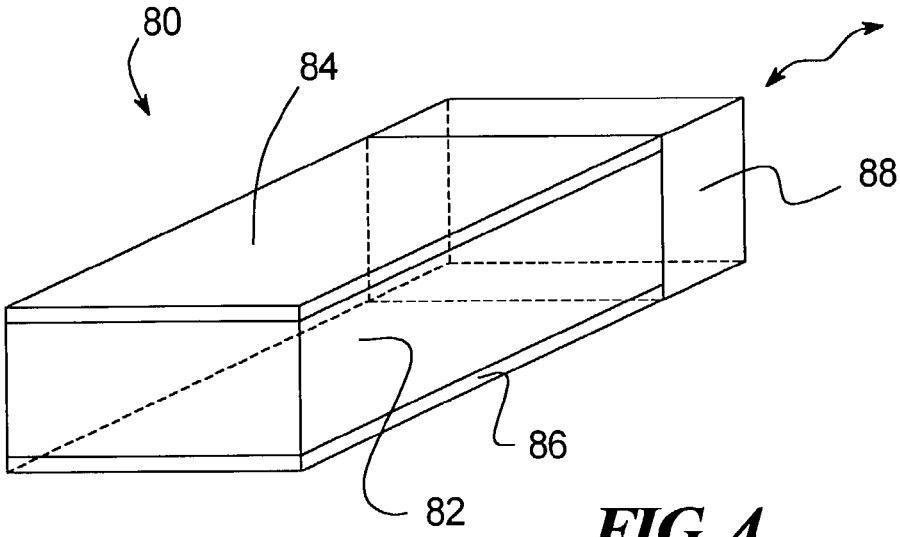
FIG. 4 illustrates one embodiment of an exemplary transducer that may be used in the monitoring and control system of FIG. 1; and, FIG. 5 illustrates another embodiment of an exemplary transducer that may be used in the monitoring and control system of FIG. 1.

FIG. 4 illustrates, by way of example, a transducer 80 that can be used for each of the transducers 38, 40, 58, and 60. The transducer 80 includes a piezoelectric material 82 sandwiched between a pair of electrodes 84 and 86. The end of the piezoelectric that receives and/or emits acoustic signals is provided with an anechoic material 88. However, more of the surface area of the transducer 80 than the emitting and receiving end as shown may be provided with the anechoic coating 88. The anechoic material 88 may be arranged as described above.

Figure 5:
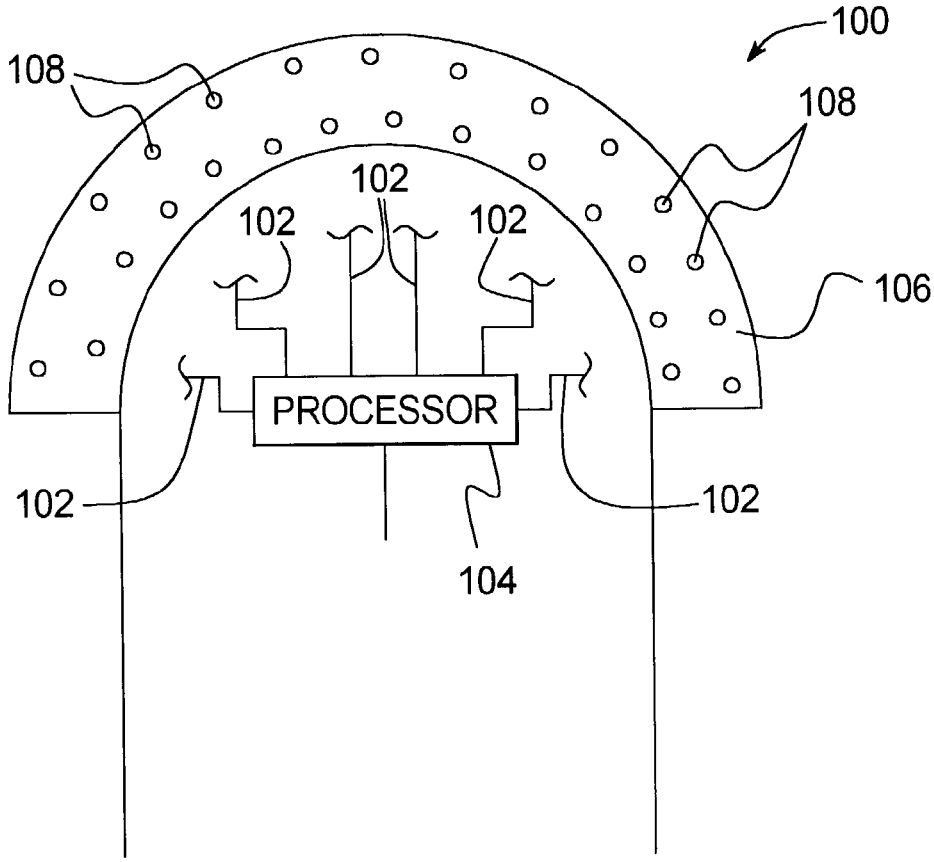

FIG. 5 illustrates, by way of example, a transmitter/transducer 100 that can be used with the surface monitoring and control system 20 and/or the down hole monitoring and control system 22. The transmitter/transducer 100 includes a plurality of piezoelectric transducers 102 coupled to a controller or processor 104. The end of the transmitter/transducer 100 that receives and/or emits acoustic signals is provided with an anechoic material 106 that is impregnated with particles 108 that enhance the acoustic signal. The anechoic material 106 may be arranged as described above. The anechoic coating 106 has a thickness as described above to enhance absorption of wanted acoustic signals and to reject out-of-phase, spurious, random, and unwahted acoustic signals.

Certain modifications of the present invention have been discussed above. Other modifications will occur to those practicing in the art of the present invention. For example, the surface monitoring and control systems 20 and the down hole monitoring and control systems 22 are provided with both transmitters and receivers in order to both transmit and receive signals. However, any of the surface monitoring and control systems 20 and the down hole monitoring and control systems 22 may be provided with only a transmitter or only a receiver if it is desired that the corresponding system only transmit or receive signals.

Also, although the surface monitoring and control systems 20 and the down hole monitoring and control systems 22 are provided with separate transmitters and receivers, the transmitter and receiver of one or more of the surface monitoring and control systems 20 and the down hole monitoring and control systems 22 may be replaced by a corresponding transceiver.

Moreover, although the surface monitoring and control systems 20 and the down hole monitoring and control systems 22 are provided with a separate transducer for each of the transmitters and receivers, a single transducer may be provided for each transmitter/receiver pair or for a transceiver used in place of a transmitter/receiver pair.

Furthermore, although transmitters and receivers are shown and described as devices that are separate from the corresponding controllers, it should be understood that the functions of the transmitters and receivers may be performed by the controllers. In that case, the controllers may be coupled directly to the transducers, or the controllers may be coupled to the transducers through other devices such as A/D and D/A converters, and/or multiplexers, and/or the like.

In addition, each of the wells 14 as described above is provided with a corresponding one of the surface monitoring and control systems 20. However, fewer surface monitoring and control systems 20 may be used so that one or more of the surface monitoring and control systems 20 covers more than one of the wells 14.

Also, the remote central control center 12 may be arranged to control all of the wells in an entire field or in multiple fields. Alternatively, the surface monitoring and control system 20 may be arranged to control all of the wells in an entire field or in multiple fields. As a further alternative, the remote central control center 12 may be eliminated and the fields may be divided up among multiple ones of the surface monitoring and control system 20, or all fields may be controlled from a single surface monitoring and control system 20.

Moreover, the surface monitoring and control system 20 is shown with the controller 30 and the down hole monitoring and control system 22 is shown with a controller 50. Alternatively, it is possible to operate the surface monitoring and control system 20 and the down hole monitoring and control system 22 without controllers.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

We claim:

1. A communication device located within a well comprising:

a transducer arranged to perform a conversion between an electrical signal and an acoustic signal, wherein the acoustic signal conveys information through the well, and wherein the acoustic signal has a wavelength $\lambda$; and, an anechoic coating provided over at least a portion of the transducer, wherein the anechoic coating has a thickness that is related to the wavelength of the acoustic signal by $x\lambda/y$ so as to reduce effects of acoustic signal impairments, wherein x and y are integers, wherein x may be less than y, wherein x may be equal to y, and wherein x may be greater than y provided that x/y is an integer.

2. The communication device of claim 1 further comprising a transmitter, wherein the transmitter is arranged to supply the electrical signal to the transducer, and wherein the transducer is arranged to convert the electrical signal from the transmitter to the acoustic signal and to supply the acoustic signal to the well.

3. The communication device of claim 1 further comprising a receiver, wherein the transducer is arranged to convert the acoustic signal to the electrical signal and to supply the electrical signal to the receiver.

4. The communication device of claim 1 further comprising a transmitter and a receiver, wherein the electrical signal comprises first and second electrical signals, wherein the acoustic signal comprises first and second acoustic signals, wherein the transmitter is arranged to supply the first electrical signal to the transducer, wherein the transducer is arranged to convert the first electrical signal from the transmitter to the first acoustic signal and to supply the first acoustic signal to the well, and wherein the transducer is arranged to convert the second acoustic signal to the second electrical signal and to supply the second electrical signal to the receiver.

5. The communication device of claim 4 wherein the transducer comprises a first transducer coupled to the transmitter and a second transducer coupled to the receiver.

6. The communication device of claim 1 wherein the transducer is arranged to convert the electrical signal to the acoustic signal and to supply the acoustic signal to the well.

7. The communication device of claim 1 wherein the transducer is arranged to convert the acoustic signal to the electrical signal.

8. The communication device of claim 1 wherein the electrical signal comprises first and second electrical signals, wherein the acoustic signal comprises first and second acoustic signals, wherein the transducer is arranged to convert the first electrical signal to the first acoustic signal and to supply the first acoustic signal to the well, and wherein the transducer is arranged to convert the second acoustic signal to the second electrical signal.

9. The communication device of claim 8 wherein the transducer comprises a first transducer arranged to convert the first electrical signal to the first acoustic signal and a second transducer arranged to convert the second acoustic signal to the second electrical signal.

10. A communication system for communicating information to and from a well comprising:

a surface monitoring and control system located at a surface and arranged to support communication through the well via an acoustic signal, wherein the surface monitoring and control system includes a first transducer arranged to perform a conversion between a first electrical signal and the acoustic signal, and wherein the first transducer is at least partially coated with a first anechoic material arranged to reduce effects of acoustic signal impairments; and, a down hole monitoring and control system located within the well and arranged to support communication through the well via the acoustic signal, wherein the down hole monitoring and control system includes a second transducer arranged to perform a conversion between a second electrical signal and the acoustic signal, and wherein the second transducer is at least partially coated with a second anechoic material arranged to reduce effects of acoustic signal impairments.

11. The communication system of claim 10 wherein the acoustic signal comprises first and second acoustic signals, wherein the surface monitoring and control system is arranged to support communication through the well via the first acoustic signal, wherein the first transducer is arranged to perform a conversion between the first electrical signal and the first acoustic signal, wherein the down hole monitoring and control system is arranged to support communication through the well via the second acoustic signal, and wherein the second transducer is arranged to perform a conversion between the second electrical signal and the second acoustic signal.

12. The communication system of claim 11 wherein the surface monitoring and control system is arranged to transmit the first acoustic signal and to receive the second acoustic signal, wherein the down hole monitoring and control system is arranged to transmit the second acoustic signal and to receive the first acoustic signal.

13. The communication system of claim 11 wherein the surface monitoring and control system is arranged to transmit the second acoustic signal and to receive the first acoustic signal, wherein the down hole monitoring and control system is arranged to transmit the first acoustic signal and to receive the second acoustic signal.

14. The communication system of claim 11 wherein the first transducer comprises a first transmitting transducer and a first receiving transducer, and wherein the second transducer comprises a second transmitting transducer and a second receiving transducer.

15. The communication system of claim 10 wherein the surface monitoring and control system includes a transmitter, wherein the transmitter is arranged to supply the first electrical signal to the first transducer, wherein the first transducer is arranged to convert the first electrical signal from the transmitter to the acoustic signal and to supply the acoustic signal to the well, wherein the down hole monitoring and control system includes a receiver, wherein the second transducer is arranged to convert the acoustic signal from the well to the second electrical signal, and wherein the receiver is arranged to receive the second electrical signal from the second transducer.

16. The communication system of claim 10 wherein the down hole monitoring and control system includes a transmitter, wherein the transmitter is arranged to supply the second electrical signal to the second transducer, wherein the second transducer is arranged to convert the second electrical signal from the transmitter to the acoustic signal and to supply the acoustic signal to the well, wherein the surface monitoring and control system includes a receiver, wherein the first transducer is arranged to convert the acoustic signal from the well to the first electrical signal, and wherein the receiver is arranged to receive the first electrical signal from the first transducer.

17. The communication system of claim 10 wherein the acoustic signal comprises first and second acoustic signals, wherein the surface monitoring and control system includes a first transmitter and a first receiver, wherein the first transmitter is arranged to supply the first electrical signal to the first transducer, wherein the first transducer is arranged to convert the first electrical signal from the first transmitter to the first acoustic signal and to supply the first acoustic signal to the well, wherein the first transducer is arranged to convert the second acoustic signal to the first electrical signal, wherein the first receiver is arranged to receive the first electrical signal from the first transducer, wherein the down hole monitoring and control system includes a second transmitter and a second receiver, wherein the second transmitter is arranged to supply the second electrical signal to the second transducer, wherein the second transducer is arranged to convert the second electrical signal from the second transmitter to the second acoustic signal and to supply the second acoustic signal to the well, wherein the second transducer is arranged to convert the first acoustic signal to the second electrical signal, and wherein the second receiver is arranged to receive the second electrical signal from the second transducer.

18. The communication system of claim 17 wherein the first transducer comprises first and second surface transducers, wherein the second transducer comprises first and second down hole transducers, wherein the first surface transducer is arranged to convert the first electrical signal to the first acoustic signal, wherein the second surface transducer is arranged to convert the second acoustic signal to the first electrical signal, wherein the first down hole transducer is arranged to convert the second electrical signal to the second acoustic signal, and wherein the second down hole transducer is arranged to convert the first acoustic signal to the second electrical signal.

19. The communication system of claim 10 wherein the first transducer is arranged to convert the first electrical signal to the acoustic signal and to supply the acoustic signal to the well, and wherein the second transducer is arranged to convert the acoustic signal from the well to the second electrical signal.

20. The communication system of claim 10 wherein the second transducer is arranged to convert the second electrical signal to the acoustic signal and to supply the acoustic signal to the well, and wherein the first transducer is arranged to convert the acoustic signal from the well to the first electrical signal.

21. The communication system of claim 10 wherein the acoustic signal comprises first and second acoustic signals, wherein the first transducer is arranged to convert the first electrical signal to the first acoustic signal for supply to the well, wherein the first transducer is arranged to convert the second acoustic signal to the first electrical signal, wherein the second transducer is arranged to convert the second electrical signal to the second acoustic signal for supply to the well, and wherein the second transducer is arranged to convert the first acoustic signal to the second electrical signal.

22. The communication system of claim 21 wherein the first transducer comprises first and second surface transducers, wherein the second transducer comprises first and second down hole transducers, wherein the first surface transducer is arranged to convert the first electrical signal to the first acoustic signal, wherein the second surface transducer is arranged to convert the second acoustic signal to the first electrical signal, wherein the first down hole transducer is arranged to convert the second electrical signal to the second acoustic signal, and wherein the second down hole transducer is arranged to convert the first acoustic signal to the second electrical signal.

23. The communication system of claim 10 wherein the down hole monitoring and control system comprises at least one sensor arranged to sense a condition within the well.

24. The communication system of claim 10 wherein the down hole monitoring and control system comprises at least one electromechanical device arranged to control flow of a fluid within the well.

25. The communication system of claim 10 further comprising a remote central control center arranged to communicate with the surface monitoring and control system.

26. The communication system of claim 10 wherein the first anechoic material has a thickness that is a fraction of a wavelength of the acoustic signal so as to reduce effects of acoustic signal impairments, and wherein the second anechoic material has a thickness that is a fraction of a wavelength of the acoustic signal so as to reduce effects of acoustic signal impairments.

27. The communication system of claim 26 wherein the surface monitoring and control system includes a transmitter, wherein the transmitter is arranged to supply the first electrical signal to the first transducer, wherein the first transducer is arranged to convert the first electrical signal from the transmitter to the acoustic signal and to supply the acoustic signal to the well, wherein the down hole monitoring and control system includes a receiver, wherein the second transducer is arranged to convert the acoustic signal from the well to the second electrical signal, and wherein the receiver is arranged to receive the second electrical signal from the second transducer.

28. The communication system of claim 26 wherein the down hole monitoring and control system includes a transmitter, wherein the transmitter is arranged to supply the second electrical signal to the second transducer, wherein the second transducer is arranged to convert the second electrical signal from the transmitter to the acoustic signal and to supply the acoustic signal to the well, wherein the surface monitoring and control system includes a receiver, wherein the first transducer is arranged to convert the acoustic signal from the well to the first electrical signal, and wherein the receiver is arranged to receive the first electrical signal from the first transducer.

29. The communication system of claim 26 wherein the acoustic signal comprises first and second acoustic signals, wherein the surface monitoring and control system includes a first transmitter and a first receiver, wherein the first transmitter is arranged to supply the first electrical signal to the first transducer, wherein the first transducer is arranged to convert the first electrical signal from the first transmitter to the first acoustic signal and to supply the first acoustic signal to the well, wherein the first transducer is arranged to convert the second acoustic signal to the first electrical signal, wherein the receiver is arranged to receive the first electrical signal from the first transducer, wherein the down hole monitoring and control system includes a second transmitter and a second receiver, wherein the second transmitter is arranged to supply the second electrical signal to the second transducer, wherein the second transducer is arranged to convert the second electrical signal from the second transmitter to the second acoustic signal and to supply the second acoustic signal to the well, wherein the second transducer is arranged to convert the first acoustic signal to the second electrical signal, and wherein the second receiver is arranged to receive the second electrical signal from the second transducer.

30. The communication system of claim 29 wherein the first transducer comprises first and second surface transducers, wherein the second transducer comprises first and second down hole transducers, wherein the first surface transducer is arranged to convert the first electrical signal to the first acoustic signal, wherein the second surface transducer is arranged to convert the second acoustic signal to the first electrical signal, wherein the first down hole transducer is arranged to convert the second electrical signal to the second acoustic signal, and wherein the second down hole transducer is arranged to convert the first acoustic signal to the second electrical signal.

31. The communication system of claim 26 wherein the first transducer is arranged to convert the first electrical signal to the acoustic signal and to supply the acoustic signal to the well, and wherein the second transducer is arranged to convert the acoustic signal from the well to the second electrical signal.

32. The communication system of claim 26 wherein the second transducer is arranged to convert the second electrical signal to the acoustic signal and to supply the acoustic signal to the well, and wherein the first transducer is arranged to convert the acoustic signal from the well to the first electrical signal.

33. The communication system of claim 26 wherein the acoustic signal comprises first and second acoustic signals, wherein the first transducer is arranged to convert the first electrical signal to the first acoustic signal for supply to the well, wherein the first transducer is arranged to convert the second acoustic signal to the first electrical signal, wherein the second transducer is arranged to convert the second electrical signal to the second acoustic signal for supply to the well, and wherein the second transducer is arranged to convert the first acoustic signal to the second electrical signal.

34. The communication system of claim 33 wherein the first transducer comprises first and second surface transducers, wherein the second transducer comprises first and second down hole transducers, wherein the first surface transducer is arranged to convert the first electrical signal to the first acoustic signal, wherein the second surface transducer is arranged to convert the second acoustic signal to the first electrical signal, wherein the first down hole transducer is arranged to convert the second electrical signal to the second acoustic signal, and wherein the second down hole transducer is arranged to convert the first acoustic signal to the second electrical signal.

35. The communication system of claim 26 wherein the down hole monitoring and control system comprises at least one sensor arranged to sense a condition within the well.

36. The communication system of claim 26 wherein the down hole monitoring and control system comprises at least one electromechanical device arranged to control flow of a fluid within the well.

37. The communication system of claim 26 further comprising a remote central control center arranged to communicate with the surface monitoring and control system.

* * * * *